US006241653B1

(12) United States Patent
Gauger et al.

(10) Patent No.: US 6,241,653 B1
(45) Date of Patent: Jun. 5, 2001

(54) ISOLATION APPARATUS

(75) Inventors: James R. Gauger, Highland Park; Joseph J. Petrovic, Burr Ridge, both of IL (US); George L. Stefanek, Beverly Shores, IN (US)

(73) Assignee: ISOVAC Products LLC, Burr Ridge, IL (US)

( * ) Notice: Subject to any disclaimer, the term of this patent is extended or adjusted under 35 U.S.C. 154(b) by 0 days.

(21) Appl. No.: 09/354,489

(22) Filed: Jul. 16, 1999

(51) Int. Cl.[7] ..... A61G 10/00

(52) U.S. Cl. ..... 600/21; 5/626; 5/627; 312/6

(58) Field of Search ..... 600/21–22; 312/1–6; 128/202.12, 205.26; 5/600, 625–628

(56) References Cited

U.S. PATENT DOCUMENTS

| | | | | |
|---|---|---|---|---|
| 4,224,936 | * | 9/1980 | Cox | 600/21 |
| 4,922,562 | * | 5/1990 | Allred et al. | 5/627 |
| 5,061,235 | * | 10/1991 | Hogan | 600/21 |
| 5,342,121 | * | 8/1994 | Koria | 312/1 |
| 5,699,568 | * | 12/1997 | Couldridge | 5/628 |
| 5,865,722 | * | 2/1999 | Heng | 600/21 |
| 6,001,057 | * | 12/1999 | Bongiovanni et al. | 600/21 |

OTHER PUBLICATIONS

Vickers Aircraft Transit Isolator Model 121.

Vickers Stretcher Transit Isolator Model 132 (see particularly p. 3).

* cited by examiner

*Primary Examiner*—John P. Lacyk
(74) *Attorney, Agent, or Firm*—Wallenstein & Wagner, Ltd.

(57) ABSTRACT

An isolation apparatus for the transport of a patient who is potentially infectious, who has been subjected to chemical or biological agents or who is threatened by chemical/biological attack. The invention comprises a transparent or semi-transparent, generally tubular enclosure, having two opposite ends. Secured to each of the two opposite ends of this transparent or semi-transparent, tubular enclosure are a pair of end walls. At least one semi-rigid support band extends around a portion of the outer periphery of the generally tubular enclosure. A base mat assembly, comprising at least a first flexible, flat sheet having a top side and a bottom side, is also a part of the invention. The top side of this first flat sheet is secured to the generally tubular enclosure. The bottom side of this sheet is secured to at least one reinforcing strap. Each of these one or more reinforcing straps has lateral ends, and the lateral ends of these straps are formed into loops. The loops serve as handholds, through which persons may grasp the isolation apparatus and transport the victim to another site for medical care. The base mat assembly of the isolation apparatus may also include a second flexible, flat sheet secured to the first flexible, flat sheet. In addition, at least two air inlet and outlet ports may be secured to each of the two end walls of the transparent or semitransparent, generally tubular enclosure.

19 Claims, 3 Drawing Sheets

10
12
14
16a
16b
16c
16d
18
20
22
24
26
28
40
43
44
50
51
52
54
56
58
60
70

ISOLATION APPARATUS

DESCRIPTION

Technical Field

This invention is an isolation apparatus for isolating an individual patient either in chemical or biological incidents or in standard medical care and transport. Such isolation may be necessary under several scenarios. First, if the individual has been exposed to a chemical or biological agent, the apparatus permits transportation and treatment of the patient from the site of the exposure to a remote uncontaminated site or facility while isolating the affected individual and protecting those responsible for transporting and treating him from accidental exposure. Second, it may be necessary to transport an uncontaminated patient through a contaminated or potentially contaminated zone. Under this condition, the apparatus prevents exposure of the patient to the chemical and biological agent while allowing transport and medical treatment. Third, the apparatus can be used to isolate and transport an infectious or potentially infectious patient under standard medical care and transport scenarios, while protecting the medical and transport personnel and vehicles from contamination. Fourth, the apparatus can be used as a portable or temporary isolation chamber in a hospital environment to protect hospital personnel and facilities from contamination by a potential or known infectious patient. Fifth, the apparatus may be used to isolate an individual such as a burn or immune compromised patient, either during transport or in a hospital environment, thereby protecting the patient from infection from outside sources.

BACKGROUND OF THE INVENTION

Governments and armed forces are increasingly concerned over the potential for the use of chemical or biological weapons in terrorist attacks or in warfare. The use of chemical or biological weapons create special concerns among rescuers. Particularly, unlike conventional weapons, exposure by rescuers to victims of chemical or biological attack can adversely affect these rescuers. To avoid such affects on rescuers, including medical and transport personnel, it is necessary to isolate the victims of the attack. Additionally, it may be necessary to transport non-contaminated patients through zones that are already contaminated or are under the threat of chemical or biological attack. Meanwhile, in the civilian sector it is increasingly required to treat all emergency patients as potentially infectious and hazardous to personnel and equipment. This requires the use of isolation techniques during transport and treatment. Further, the resurgence of virulent strains of other diseases has required that the civilian medical community consider the need for individual isolation facilities.

Many United States Patents describe various devices for the isolation of victims, and other generally similar devices, some of them portable, for providing sterilized operating environments. These United States Patents include U.S. Pat. Nos. 5,725,426; 5,630,296; 5,626,151; 5,331,991; 5,314,377; 4,000,749; 3,766,844; 3,695,507; 3,272,199; 3,265,059; 3,119,358; 3,118,401; 2,985,129; and 2,683,262.

SUMMARY OF THE INVENTION

The invention is an isolation apparatus for isolating an individual patient, either in chemical or biological incidents or in connection with standard medical care and transport. The invention comprises a transparent or semi-transparent, generally tubular enclosure, having two opposite ends.

Secured to each of the two opposite ends of this transparent or semi-transparent, tubular enclosure are a pair of end walls. At least one semi-rigid support band extends around a portion of the outer periphery of the generally tubular enclosure.

A base mat assembly, comprising at least a first flexible, flat sheet having a top side and a bottom side, is also a part of the invention. The top side of this first sheet is secured to the underside of the generally tubular enclosure. The bottom side of this first sheet is secured to at least one reinforcing strap.

Each of these one or more reinforcing straps has lateral ends, and the lateral ends of these straps are formed into loops. The loops serve as handholds, through which persons may grasp the isolation apparatus and transport the victim to another site for medical care.

The base mat assembly of the isolation apparatus may also include a second flexible, flat sheet secured to the underside of the first flexible, flat sheet. In addition, at least two air inlet ports may be secured to one end wall, and two air outlet ports may be secured to the other of the two end walls of the transparent or semi-transparent, generally tubular enclosure.

BRIEF DESCRIPTION OF THE DRAWINGS

FIG. 4 is a partially exploded, end view of a second embodiment of the apparatus of FIGS. 1 and 2, showing a somewhat different base mat assembly of this second embodiment, which base mat assembly includes two flexible, flat sheets, with the top side of the first sheet being secured to the underside of the generally tubular enclosure, and with both the bottom side of the first sheet and the top side of the second sheet being secured to each other and to the reinforcing straps sandwiched between.

DETAILED DESCRIPTION

This invention may take many different forms. The drawings and the description of the invention detail several preferred embodiments of the invention. It should be understood that the present disclosure is to be considered as but an example of the principles of the invention. The disclosure is not intended to limit the broad aspect of the invention to the embodiments illustrated.

Figure 6:
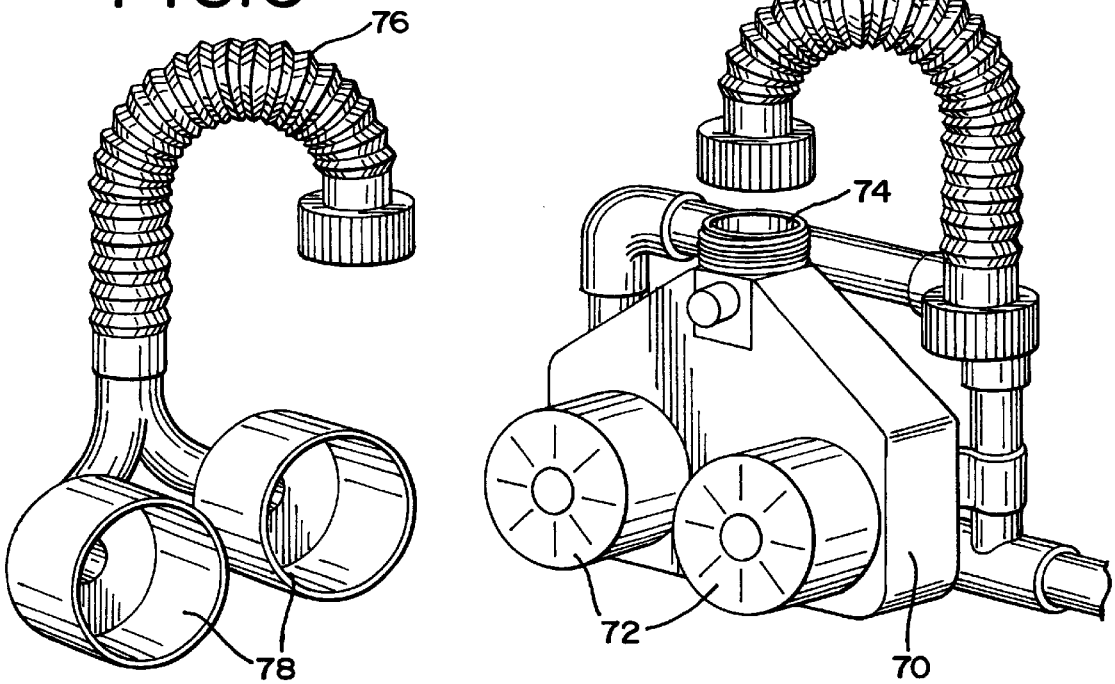
FIG. 6 is a perspective view of a blower/filter/filter inlet adapter assembly used for ensuring that the contaminants within the confines of the apparatus of the invention do not escape to, and contaminate, the atmosphere, or alternatively that contaminants in the atmosphere do not enter the apparatus.
Figure 7:
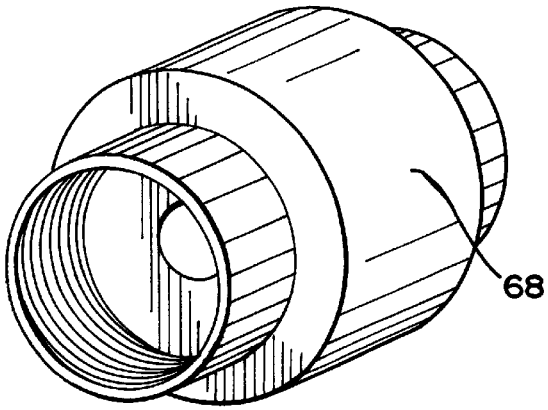
FIG. 7 is a perspective view of a check valve for maintaining unidirectional air flow to and from the interior of the apparatus.
Figure 8:
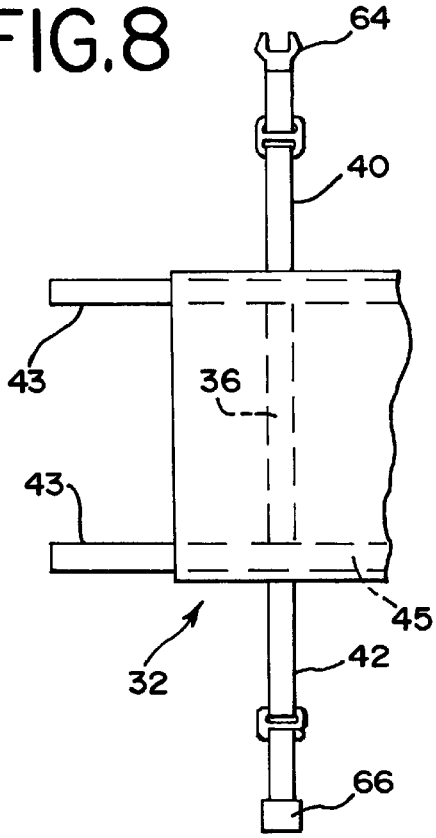
FIG. 8 is a partial plan view of the base mat assembly of the apparatus of FIG. 2, showing the details of the reinforcing strap's placement within, and relationship to, the base mat assembly.

This apparatus is used for transporting or isolating patients who have been exposed to chemical or biological agents, who may be exposed to such agents during transport, or who are potentially infectious. Transporting is generally necessary to move such patients to advanced medical care facilities. Isolation is necessary either to protect transport and medical personnel against dangerous exposure to these same chemical, biological, or infectious agents, or to protect a non-contaminated patient from anticipated chemical or biological attack. This isolation apparatus 10 itself is shown generally in FIGS. 1–5 and 8, while auxiliary components of this apparatus are shown in FIGS. 6–7.

Figures 1, 2:
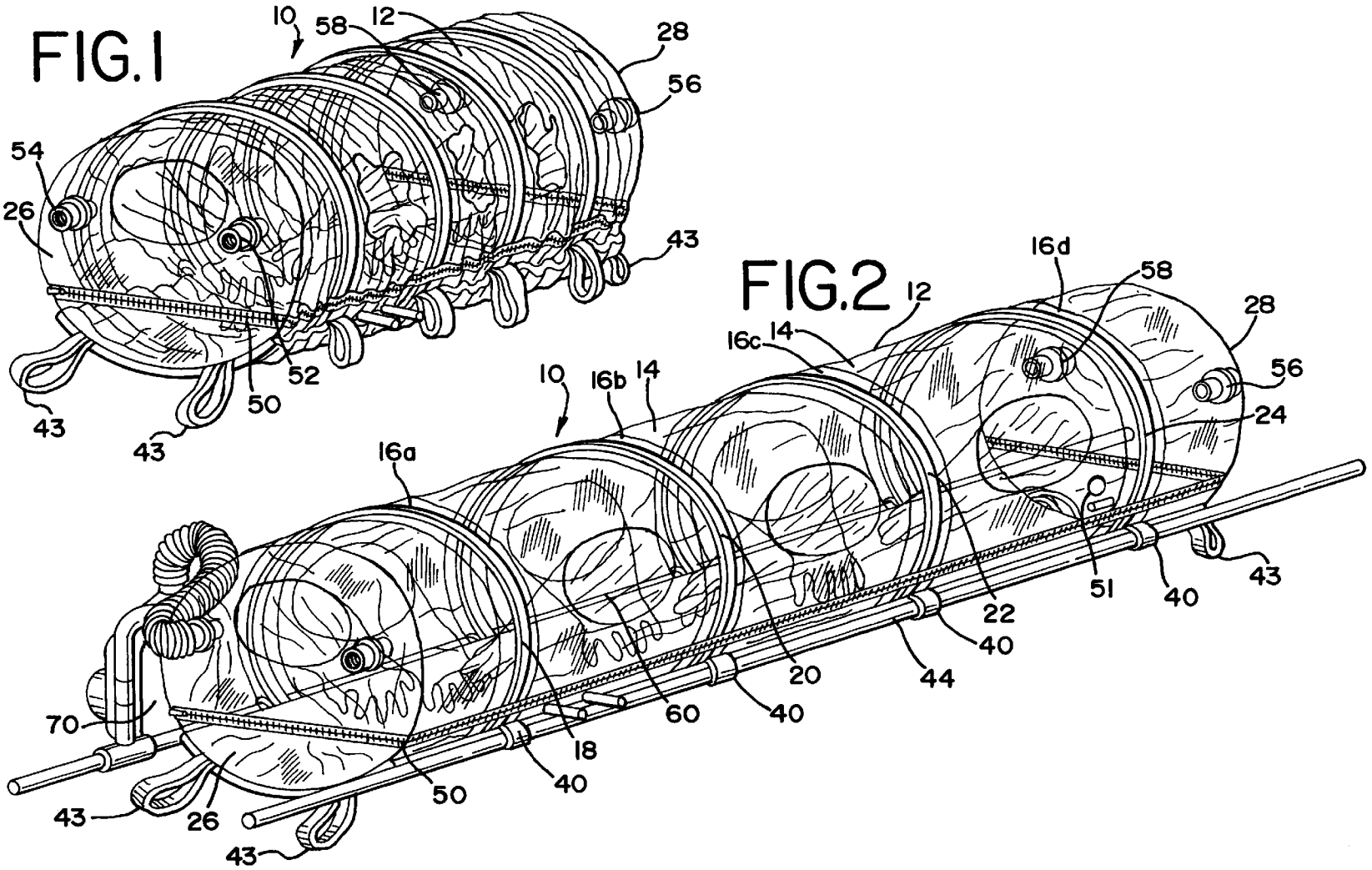
FIG. 1 is a perspective view of the apparatus of the invention in a folded state.
FIG. 2 is a perspective view of the apparatus of FIG. 1 in its normal, ready-to-use extended state.

The apparatus 10 comprises a transparent or semi-transparent, generally tubular enclosure 12. The preferred fabric or material for this enclosure 12 is a transparent or semi-transparent flexible plastic, such as an eight (8) mil (0.008 inch) polyvinylchloride (PVC). A first PVC layer 14 may be seen in FIGS. 3–5. An optional second PVC layer 16 may also be seen in FIGS. 3–5. This second PVC layer 16 may cover only a portion of the first PVC layer 14, as shown in FIG. 2, or it may cover the entire first PVC layer 14. The first and second PVC layers, if both are clear, are available from McMaster-Carr Supply Co., Elmhurst, Ill., as Stock No. 8562K. A tinted PVC layer, especially as the second PVC layer 16, may alternatively be used. This tinted PVC layer provides the apparatus 10 with an infrared barrier. In a hot climate, this infrared barrier reduces solar heating of the interior, and thus the heat load on the patient inside the apparatus 10. In cold climates, this infrared barrier will reduce the heat loss from the interior of the apparatus 10. This second, tinted PVC layer 16 is also available from McMaster-Carr Supply Co., Elmhurst, Ill. All seams in enclosure 12 are sealed and secured by heat welding.

In the embodiment shown in FIG. 2, the second PVC layer 16 comprises four strips 16*a*, 16*b*, 16*c*, and 16d covering only a portion of the first PVC layer 14. In particular, the second PVC layer covers the part of the first PVC layer 14 adjacent to each of four semi-rigid support bands 18, 20, 22, 24 extending around a portion of the outer periphery of the generally tubular enclosure 10. High density polyethylene, McMaster-Carr Stock No. 8619K, is an excellent material for these semi-rigid support bands 18, 20, 22, and 24.

By placing these four semi-rigid support bands 18, 20, 22, and 24 along the outer periphery of the apparatus 10, the inside of the apparatus can be kept smooth, such that contaminants on the inside of the apparatus 10 can be more easily and reliably cleaned. Strips 16*a*, 16*b*, 16*c*, and 16*d* are all slightly wider than the support bands 18, 20, 22, and 24 that they overlie. Each of these strips 16*a*, 16*b*, 16*c*, and 16*d* are heat-sealed, i.e., heat welded, onto the underlying first PVC layer 14.

It is not necessary to use all four support bands 18, 20, 22, and 24 with the apparatus 10. Rather, as few as one support bands 18 can be used. This single support band 18 may be placed at the head end of the apparatus 10, so that the flexible, tubular enclosure 12 will not fall onto the face and head of the patient, but will instead be supported above and away from the patient's head.

When, in another embodiment not shown in the Figures, the second PVC layer 16 is of the same approximate dimensions as the first PVC layer 14, the two layers are overlain upon each other, creating a full, double-layered structure for the apparatus 10. This full, double-layered structure provides additional assurances against transmission of the chemical, biological, or infectious contaminants between the atmosphere, and the interior of the enclosure, in that if one of the two layers is pierced or ruptured, the remaining layer will still ensure that the apparatus 10 retains its integrity.

In either of the above-described embodiments, one novel aspect of the apparatus 10 is that it is completely self-enclosed. Particularly, together with its two ends walls 26 and 28 at the opposite ends of the tubular enclosure 12, that transparent or semi-transparent generally tubular enclosure 12 is impervious to the surroundings, and able to prevent contaminants from leaving or entering the apparatus independent of the base mat assembly.

Regarding the four support bands 18, 20, 22, and 24 described above, the support bands are of a semi-rigid character. By this is meant that the support bands 18, 20, 22, and 24 can be flexed, much like a thin plastic band, while displaying some rigidity, and can also be flexed without breaking. Preferably, as may be seen in FIGS. 3–5, support band 18, like the remaining support bands 20, 22, and 24, extends around only a portion of the outer periphery 30 of the generally tubular enclosure 12.

Figure 3:
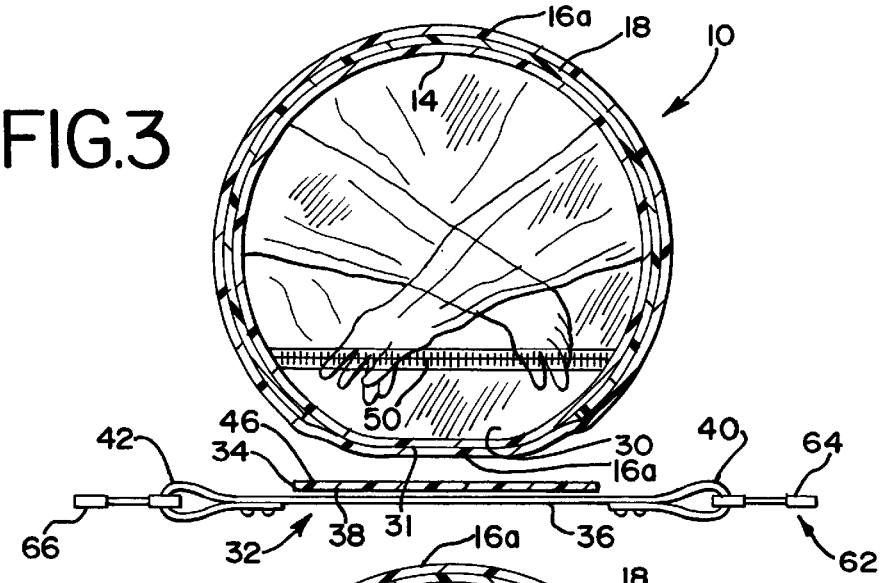
FIG. 3 is a partially exploded, end view of a first embodiment of the apparatus of FIGS. 1 and 2, showing the base mat assembly of this first embodiment, which includes one flexible, flat sheet having a top side that is secured to the underside of the generally tubular enclosure, and which also includes reinforcing straps secured to the bottom of that flexible, flat sheet.

However, a separate element may also be secured to the outer periphery 30 of the generally tubular enclosure 12. This separate element, as shown in FIG. 3, is a stiffening rib 31. This stiffening rib is preferably made of the same material as the support bands 18, 20, 22, and 24, and is preferably of approximately the same width as those support bands. Preferably, one stiffening rib 31 is provided for each of the four support bands 18–24. The stiffening ribs 31 are positioned on the underside of the generally tubular enclosure 12, and directly in line with the support bands 18–24. Essentially, the stiffening ribs 31 act as an unattached continuation of their respective support bands 18, 20, 22, or 24. These stiffening ribs 31 have several purposes. First, they help to retain the flat configuration of the base mat assembly 32, to be described below. Second, the stiffening ribs 31 provide a natural support point for the ends of the support bands 18, 20, 22 and 24. The stiffening ribs 31 are also covered by second layer strips 16*a*–16*d* or by the second layer 16.

Figure 4:
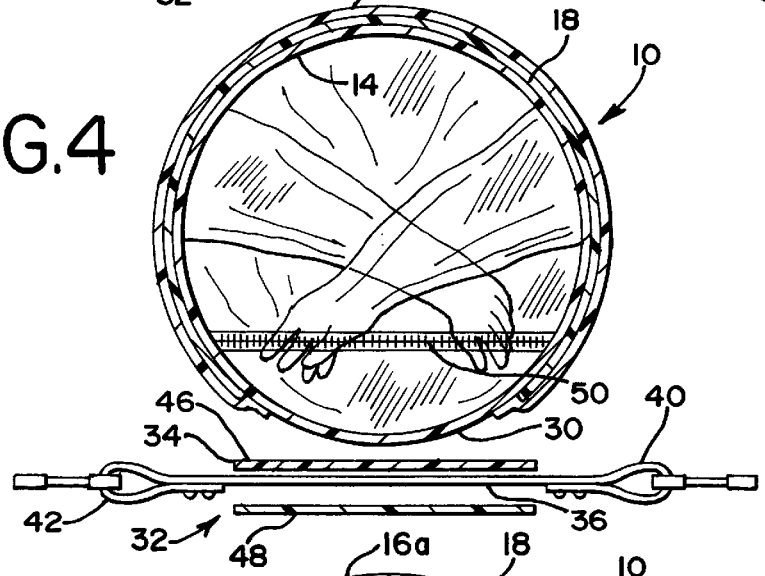

In addition, the apparatus 10 may include a base mat assembly 32. FIGS. 3 and 4 show two different types of base mat assemblies 32. In the first embodiment, shown in FIG. 3, the base mat assembly 32 includes a first flexible, flat sheet 34. In the second embodiment, shown in FIG. 4, the base mat assembly includes both a first flexible, flat sheet 34 and a second flexible, flat sheet 48, which is attached to the first flexible, flat sheet 34 by means of heat welding. Both flexible flat sheets 34 and 48 are made of a synthetic mesh-type material which has been PVC coated on both sides and has an ultraviolet shield, making it suitable for outdoor use. Both flexible flat sheets 34 and 48 may be obtained from McMaster-Carr Supply Company, as Catalog No. 8843K. The base mat assembly 32 is not necessary for the apparatus 10 to be self-contained and impervious, as described above. Rather, the base mat assembly 32 is positioned at the bottom of the apparatus 10 to provide the vulnerable bottom of the apparatus 10 with additional puncture, skid, and tear resistance, and to provide an auxiliary means of lifting the apparatus 10 while containing a patient.

In the embodiment of FIG. 3, the base mat assembly 32 also includes one or more lateral reinforcing straps 36, which straps 36 are made of nylon webbing. For the purposes of this invention, "lateral" means straps that are perpendicular to the main axis of the apparatus 10. The lateral orientation of one of the straps 36 may best be seen in FIG. 8. Suitable nylon webbing for these reinforcing straps 36 is available from McMaster-Carr Supply Co. as Product No. 87425K77. These straps 36, which are secured to the bottom 38 of the flat sheet 34, serve as supplemental reinforcing means for the base mat assembly 32.

Figure 5:
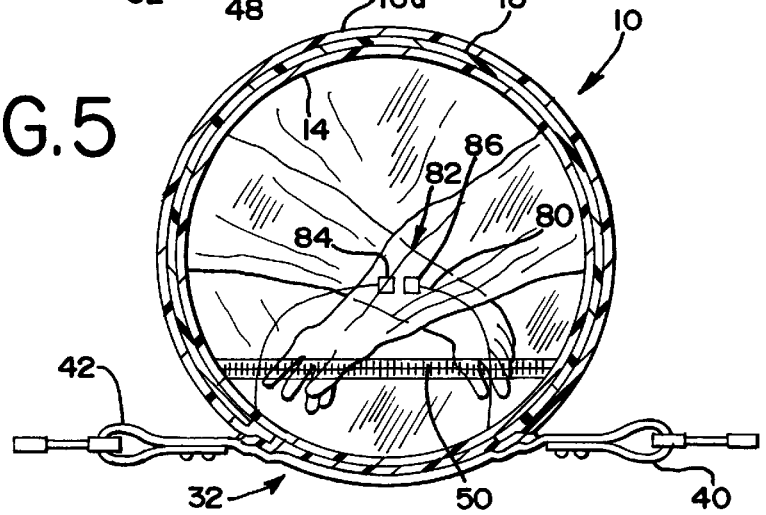
FIG. 5 is an end view of the apparatus of FIG. 4, but showing the base mat assembly secured to the generally tubular enclosure.

As may be seen in FIGS. 3–5, the ends of each of the reinforcing straps 36 may be looped to form handholds 40 and 42. The patient within the enclosure may be transported by individuals who place their hands in these handholds 40 and 42. In addition, as may be seen in FIG. 2, four (4) additional handholds 43 may be provided. Two of these handholds 43 may be adjacent end wall 26 and two of these handholds 43 may be adjacent end wall 28. These handholds 43 are formed at the end of two longitudinal reinforcing straps 45, made of the same nylon webbing material as the lateral reinforcing straps 36.

As may also be seen in FIGS. 3–5, the top side 46 of this flat sheet 34 is secured to the underside of the isolation apparatus 10 by means of heat welding.

In the alternate embodiment of FIG. 4, a second flexible, flat sheet 48, preferably of the same construction as first, flexible flat sheet 34, is included as a component of the base mat assembly 32. In this embodiment of FIG. 4, the first and second sheets 34 and 48 enclose or "sandwich" the central portions of any reinforcing straps 36. In base mats assemblies having two flat sheets or PVC layers, the contacting edges of the adjacent flexible flat sheets 34 and 48 are heat welded together, or otherwise sealed to each other, to avoid contamination that can result if foreign substances find their way between the two flexible, flat sheets 34 and 48.

In summary, the base mat assembly 32 of this invention is most preferably a combination of (1) at least one flexible, flat PVC sheet that is secured to the underside of the isolation apparatus; (2) with one to six straps, preferably four lateral straps and two longitudinal straps, used to form the handholds, and to reinforce the flexible, flat PVC sheet; and (3) optionally, combined with a second flexible, flat PVC sheet, which two flexible, flat PVC sheets are sealed together by heat welding.

In order to insert the victim into the isolation device, and then to close the isolation device so that it forms a sealed air-tight unit, a zipper 50 is provided. For a typical 84"-long isolation device, as shown in FIG. 2, the zipper would be approximately twelve (12') feet in length. The type of zipper necessary, which will prevent air or liquid contaminant passage between the inside of the isolation apparatus and the outside of the apparatus, is known as a pressure sealed zipper. Such zippers are available from YKK Corporation, 1, Kandaizumi-cho, Chiyoda-ku, Tokyo, 101-8642, Japan, phone (03)3864-2103.

As may be seen in FIG. 2, this zipper 50 is secured to, and the apparatus 10 opens along (i) one lengthwise side of, that apparatus 10; and (ii) the two opposite ends 26 and 28 of that apparatus 10. It is not secured to the opposite lengthwise side of the apparatus 10. Essentially, then, the zipper 50 extends along three of the four sides of the apparatus 10. In addition, as may also be seen in FIG. 2, this zipper 50 is positioned along the lower end of the apparatus 10, and is particularly positioned well below the center line or central axis of that apparatus 10. Accordingly, when the zipper 50 is opened to either place a patient within or remove a patient from the apparatus 10, the apparatus 10 opens along a hinge formed by the opposite (unzippered) lengthwise side. As a result, the apparatus 10 opens like a clamshell. This clamshell-type opening of the apparatus 10 enables the attending medical personnel to use the "roll method" to place the patient into the apparatus 10.

As a result of the low placement of the zipper 50, the apparatus 10 can easily accommodate certain elements that assist in the treatment of the patient and in the sanitization of the apparatus 10. For example, above the zipper 50, as may be seen in FIG. 1, end walls 26 and 28 may include at least either two air inlet or two air outlet ports. Air inlet ports 52 and 54 are secured to end wall 26, while air outlet ports 56 and 58 are secured to end wall 28. Each inlet and outlet port 52, 54, 56, and 58 is a one (1)-inch inside diameter, injection molded PVC nipple which is heat welded to the end panel 26 or 28. Each inlet and outlet port 52, 54, 56, and 58 further comprises a plastic 40 mm DIN male thread fitting, a female-threaded cap, and a band clamp. Also above the zipper 50, as may be seen in FIG. 2, are a plurality of conventional glove arms 60, which permit medical intervention even when the zipper 50 of the apparatus 10 is closed and the apparatus 10 is sealed. The apparatus 10 of FIG. 2 uses seven (7) glove arms 60. As may be seen in that FIG. 2, six of the glove arms 60 are placed opposite each other, i.e., three on each of the two lengthwise sides of the apparatus 10, and the seventh glove arm 60 is placed in the head end 26 of the apparatus 10.

Below the line of the zipper 50, at the bottom of the apparatus 10, a drain port 51 may be placed for the draining of fluids used to decontaminate the apparatus 10 after use. The drain port 51 is preferably placed at the foot end of the apparatus 10, i.e., in the lower end of end wall 28. Also below the line of the zipper 50, but along the lengthwise sides of the apparatus 10, access ports (not shown) may be placed for permitting access to the patient with electrocardiogram (EKG) leads, catheters, syringes, and the like. These access ports do not compromise the sealed nature of the apparatus, because they are either clamped shut or sealed with a removable cap when not in use, or are sealed by means of flexible PVC tape when instrument leads or medical tubing are inserted through the ports. The drain port 51 and all medical access ports comprise a one (1)-inch inside diameter injection molded PVC nipple which is heat welded to an end wall 26 or 28, or to the side of the generally tubular enclosure 12. Each of these ports further comprise a plastic 40 mm DIN male thread fitting, a female threaded cap, and a band clamp.

As may be seen in FIGS. 3–5, the isolation apparatus 10 includes a plurality of buckles 62. The buckles 62 are attached to the handholds 40 and 42 at the opposite ends of the reinforcing straps 36. Each buckle 62 includes a conventional male end 64 and a female end 66. When these male 64 and female ends 66 are brought together, they enable a clamping securement of the apparatus 10 to the standard military litter 44. In addition, two sets of nylon straps are provided on the inside of the apparatus 10, to serve as patient tethers 80. The tethers 80 are located at chest and thigh position of the patient and are heat welded to the enclosure 12. The tethers 80 are comprised of the same nylon webbing as reinforcing straps 36. The ends of the patient tether straps include buckles 82 consisting of male ends 84 and female ends 86. When these male 84 and female 86 ends are brought together, they enable a securing of the patient within the apparatus 10.

Referring again to FIGS. 1 and 2, at least one semi-rigid (nylon) support band 18 should extend around at least a portion of the outer periphery 30 of the generally tubular enclosure 12. For an apparatus 10 that includes but one support band 18, that band 18 should be placed adjacent the portion of the isolation apparatus that will enclose the head of the victim. Accordingly, such a single semi-rigid polyethylene support band will be positioned adjacent the so-called head end of the apparatus 10, i.e., adjacent end wall 26.

FIG. 6 shows a blower/filter/filter inlet adapter assembly which is to be secured to the apparatus 10. FIG. 7 is a check valve 68. Like conventional check valves, this check valve 68 permits flow of air in only one direction, and prevents the flow of air in the opposite direction.

FIG. 6 shows a blower unit 70, and its outlet port 74. Air is drawn into the blower unit 70 through a pair of conventional NATO-type chemical/biological/nuclear (CBN) filters 72. The outlet air from the blower is thus filtered and decontaminated. FIG. 6 also shows filter inlet adapters 78 and air inlet hose 76. The filter inlet adapters 78 each comprise a custom PVC injection molded cup and nipple which fits over and pressure seals to the inlet side of a CBN filter. This allows air inlet hose 76 to attach to the CBN filter 72 inlet ports without modifying the filter housing. This feature is unique and key to employing standard positive pressure CBN blower/filter assemblies for negative pressure generation within the apparatus 10.

When apparatus 10 is used to contain a non-contaminated patient, its interior must be under slight positive pressure and filtered air must be supplied to the patient. In this scenario, the blower assembly 70–76 is mounted at the head end 26 of the apparatus 10 and the blower outlet 74 is connected to one of the inlet ports 52 or 54 by means of a flexible hose and 40 mm DIN female threaded slip coupling. The inlet of check valve 68 is attached to outlet port 56 or 58 to prevent backflow of contaminated air. Unused inlet or output ports are left capped and sealed. In this manner, clean air is injected into the head end 26 of apparatus 10 and exhausted at the foot end 28, supplying the patient with clean air and providing a positive pressure within the apparatus 10.

When apparatus 10 is used to contain a contaminated patient, its interior must be under slight negative pressure and the air exhausted from within must be filtered to avoid contaminating the outside atmosphere. In this scenario, the blower assembly 70–76 is mounted at the foot end 28 of apparatus 10 and the filter inlet hose 76 is connected to one of the outlet ports 56 or 58. The outlet of check valve 68 is now connected to one of the input ports 52, 54. Unused inlet or output ports are left capped and sealed. In this manner, clean air is drawn in through the check valve across the patient and sucked out at the foot end 28 by the blower assembly 70–76, thus supplying the patient with clean outside air and providing a negative pressure within apparatus 10. Contaminated air from within apparatus 10 is thus filtered before being exhausted to the atmosphere.

Specific embodiments have been illustrated and described. Numerous modifications come to mind without significantly departing from the spirit of the invention. The scope of protection is only limited by the scope of the accompanying Claims.

What we claim is:

1. A foldable isolation apparatus for transporting patients, comprising:

(a) a transparent or semi-transparent, generally tubular enclosure, having two opposite ends, said tubular enclosure being foldable into a collapsed form having a significantly reduced length or footprint and a diameter no larger than that of the expanded generally tubular enclosure;

(b) a pair of end walls secured to the tubular enclosure at its opposite ends such as to form a completely self contained and sealed, air-tight apparatus;

(c) semi-rigid support bands extending around a portion of the outer periphery of the generally tubular enclosure;

(d) a base mat assembly, comprising at least a first flexible, flat sheet having a top side and a bottom side, its top side being secured to said generally tubular enclosure.

2. The isolation apparatus of claim 1, wherein said bottom side of said base mat assembly is secured to at least four lateral reinforcing straps.

3. The isolation apparatus of claim 1, wherein said bottom side of said base mat assembly is secured to at least two longitudinally oriented reinforcing straps.

4. The isolation apparatus of claim 1, wherein the ends of said lateral reinforcing straps are formed into loops, which loops serve as handholds.

5. The isolation apparatus of claim 2, wherein said base mat assembly further comprises a second flexible, flat sheet secured to the bottom side of said first flexible, flat sheet.

6. The isolation apparatus of claim 1, further comprising at least two air inlet and outlet ports secured to each of the two end walls of the transparent or semi-transparent, generally tubular enclosure, said ports allowing connection to a blower/filter assembly to positively pressurize the enclosure when blowing air into the inlet port and negatively pressurize the enclosure when exhausting air from the outlet port while maintaining head to foot air flow.

7. The isolation apparatus of claim 1, further comprising a zipper along three of four sides of said generally tubular enclosure, permitting said enclosure to pivot along said fourth side, and thereby permit easy access to the interior of said enclosure.

8. The isolation apparatus of claim 7, wherein said zipper is air- and liquid-tight.

9. The isolation apparatus of claim 7, wherein said zipper is placed along said three sides at a point below the center line of said enclosure.

10. The isolation apparatus of claim 1, wherein said transparent or semi-transparent, generally tubular enclosure is made of a first layer and optionally a second layer overlapping substantially all of said first layer.

11. The isolation apparatus of claim 1, further comprising a drain port adjacent to the bottom of said apparatus.

12. The isolation apparatus of claim 2, wherein opposite ends of said reinforcing straps include integral buckles for securing the apparatus to a stretcher.

13. The isolation apparatus of claim 1, further comprising two sets of patient tether straps and integral buckles for securing a patient within the apparatus.

14. The isolation apparatus of claim 10, wherein said second layer incorporates an infrared heat barrier.

15. The isolation apparatus of claim 1, wherein the ends of said longitudinal reinforcing straps are formed into loops, which loops serve as handholds.

16. The isolation apparatus of claim 2, further comprising two sets of patient tether straps and integral buckles for securing a patient within the apparatus.

17. The isolation apparatus of claim 1, further comprising multiple medical instrumentation access ports located below a zipper along three of the four sides of said generally tubular enclosure, said medical instrumentation access ports being on the lengthwise side of the apparatus.

18. The isolation apparatus of claim 9, further comprising multiple medical access ports located below said zipper on the lengthwise side of the apparatus.

19. The isolation apparatus of claim 1, wherein said support band acts as a stiffening rib.

* * * * *